United States Patent [19]

Jacobson

[11] Patent Number: 4,922,228

[45] Date of Patent: May 1, 1990

[54] RAILING

[75] Inventor: Amnon Jacobson, Tel Aviv, Israel

[73] Assignee: Ispra Israel Products Research Co., Ltd., Israel

[21] Appl. No.: 231,198

[22] Filed: Aug. 11, 1988

[30] Foreign Application Priority Data

Aug. 25, 1987 [IL] Israel ..... 83634

[51] Int. Cl.[5] ..... G08B 13/18

[52] U.S. Cl. ..... 340/550; 350/96.29; 340/552

[58] Field of Search ..... 340/550, 541, 666, 665, 340/555, 552; 350/96.29, 96.30, 96.15, 96.23

[56] References Cited

U.S. PATENT DOCUMENTS 4,586,030 4/1986 Klostermann ..... 350/96.29

4,701,614 10/1987 Jaeger et al. ..... 350/96.29

*Primary Examiner*—Joseph A. Orsino

*Assistant Examiner*—Jeffrey A. Hofsass

*Attorney, Agent, or Firm*—Steinberg & Raskin

[57] ABSTRACT

The present invention relates to a railing selected among hollow railings, grilles, tubes or the like in which a continuous sensor made of an optical fiber extends, which railing is filled with a suitable filling material, the sensor fiber being connected to outside control and/or alarm units to form a complete circuit. The optical fiber has advantageously a numerical aperture (NA) of $0.08 \leqq NA \leqq 0.5$ preferably the following parameters:

Bending loss $\alpha \exp(-\beta r)$, r-Bending radius $\beta \alpha$N.A. (b/a) $\triangleq \gamma$ b-cladding radius, a-core radius of the fiber, $0.1 \leqq \gamma \leqq 3.0$.

The filling material has preferably the form of pellets and is suitably selected among glass, steel, ceramics or sand.

The railing preferably comprises a binder selected among soft rubber and plastics, e.g. a polyester. The binder may comprise also a material selected among an irritating material and a dye.

The railing may also be a system of railing wherein the sensor extends through all the railings.

2 Claims, 2 Drawing Sheets

RAILING

BACKGROUND OF THE INVENTION

The present invention relates to hollow railings, bars, grilles, tubes, etc., (hereinafter called "railings"), used as a protection from intruders to commercial buildings, to prevent escape in the case of a jail building, etc.

There are known such railings being provided with an optical fibre or a wire threaded inside through hollow bars connected to discrete sensors and/or to a control and an alarm. Said "alarm" is activated upon cutting of the optical fibre or wire.

The hollow section of these railings are optionally filled with protection material after the optical fibre or wire is inserted.

The known railings are not entirely satisfactory for intrusion detection particularly as they require cutting of the fibre or wire.

It has thus been desirable to develop a railing which overcomes the above drawback. Said railing should be very sensitive to activate the alarm not only while the fibre is cut, but also at an earlier stage or even when the railing is bent without any cutting. Said railing should be easy to manufacture and to mount on the site to be protected.

SUMMARY OF THE INVENTION

The present invention thus consists in a railing (as herein defined) in which extends a continuous sensor made of an optical fibre which railing is filled with a suitable filling material, said sensor fibre being connected to outside control and/or alarm units to form a complete circuit.

The present invention consists also of a system comprising more than one railing, the sensor fibre extending through all said railings and being connected to the outside control and/or alarm unit.

The railings may have any desired cross-section, e.g., be round, rectangular, etc. They may be made of any suitable material. e.g., steel, Suitable optical fibres for the railing according to the present invention have a numerical aperture (NA) of $0.08 \leqq NA \leqq 0.5$.

The optical fibre may be of a type having, for example, the required macro-bending sensitivity and have the following parameters:

Bending loss $\alpha \exp(-\beta r)$, r-Bending radius $\beta\alpha$N.A. (b/a) $\Delta\gamma$ b-bladding radius, a-core radius of the fibre $0.1 \leqq \gamma \leqq 3.0$.

The railing according to the present invention comprises advantageously besides the filling material, also a binding material.

The binder and/or filler combination activates the sensor fibre and does not merely protect said fibres as is the case with the known railings.

The binder may be made of any suitable elastic material, e.g., soft rubber, plastics such as polyester, etc., cast into the hollow space and after having been dried behaves as an elastic solid. Said casting is advantageously performed in a liquid state after the optical sensing fibre was threaded inside and the filling material was inserted. The binding material becomes after drying, solid (rigid or flexible). The binder and the filler become an integral part of the railing.

The binding material may contain irritating materials such as C.S. (Orthochlorobenzalmalononitrile), C.N. (chloroacetophenone) or any other kinds of irritating or dye material. This may effect the intruder upon cutting the bar, and result in a desirable secondary effect. (Eye irritation, or dye marking that will allow easy identification of the intruder).

The filling material has preferably the form of rigid pellets, grains, balls, rods, etc. (hereinafter called "pellets"). It may be for example, made of glass, steel, ceramic, sand, etc. Said pellets should be able to be displaced within the hollow railings when under an outside pressure, causing force that results in bending of the optical fibre thus activating it.

Although it is preferred as indicated above, to use a combination of a binder and a filler, there may be used, if desired, filler pellets only. The sysstem will be activated when the wall of the hollow railing is cut and the forced pellets cause bending in the sensor fibre.

Moreover, as the filler consists of hard material particles, the intruders device such as handsaw will not be able to cut easily through the hard material particles. In addition, the particles will resist cutting by their rotations about their own axis.

In case of intruders cutting through the hard particles by using any other kind of cutting equipment including burner, the sensing fibre will activate the system by giving the signal, when cut.

BRIEF DESCRIPTION OF THE DRAWINGS

The present invention will now be illustrated with reference to the accompanying drawings without being restricted by them. In said drawings.

DESCRIPTION OF THE PREFERRED EMBODIMENTS

Figure 1:
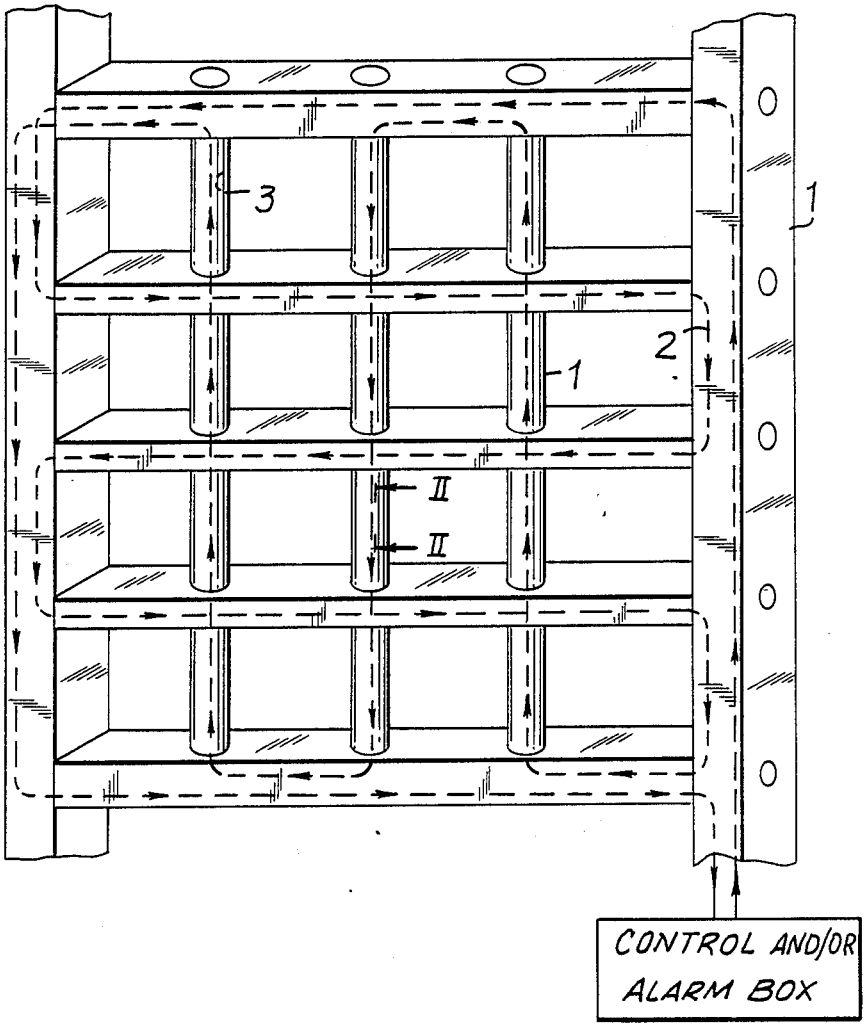
FIG. 1 shows a perspective view of a railing according to the present invention.
Figure 2:
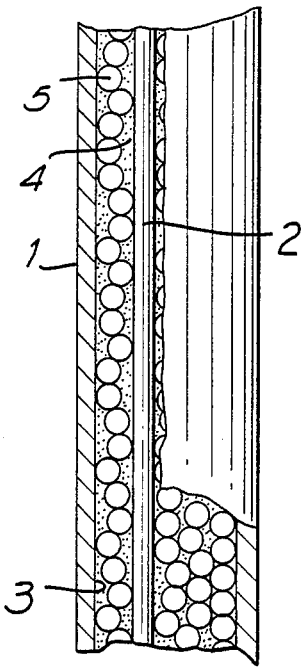
FIG. 2 shows a section along line II—II in FIG. 1.
Figure 3:
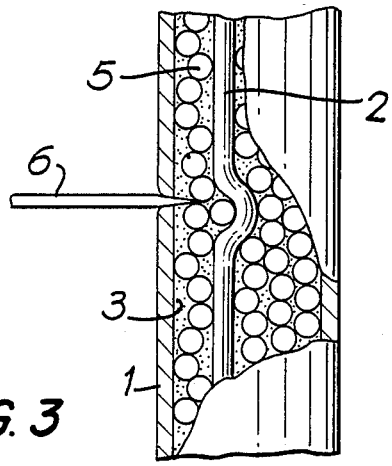
FIG. 3 shows a section as in FIG. 2 when being attacked by an intruder.

The railing shown in FIGS. 1 to 3 comprises railing 1, optical fibre 2, hollow space 3 being filled with binding material 4 and pellets 5.

When the railing is attached as shown in FIG. 3 the cutting equipment 6 will push the hard pellets 5 through soft elastic binder 4 and the closed packed particles will activate sensin fibre 2 by bending it, long before the cutting equipment will reach sensor 2 by cutting through.

I claim:

1. A railing in which a continuous sensor made of an optical fibre extends, which railing is filled with a suitable filling material bounding said sensor fibre, and a binder surrounding said filling material, said binder additionally comprising a material from among an irritating material and a dye, said sensor fibre being connected to an outside control or alarm unit to form a complete circuit whereby the control or alarm unit is activated upon a predetermined change in the sensor output.

2. The railing of claim 1, wherein said material is orthochlorobenzalmalononitrile or chloroacetophenone.

* * * * *